US008534660B2

(12) United States Patent
Honda

(10) Patent No.: US 8,534,660 B2
(45) Date of Patent: Sep. 17, 2013

(54) SHEET PROCESSING APPARATUS AND IMAGE FORMING APPARATUS

(75) Inventor: Masao Honda, Nagoya (JP)

(73) Assignee: Ricoh Company, Ltd., Tokyo (JP)

( * ) Notice: Subject to any disclaimer, the term of this patent is extended or adjusted under 35 U.S.C. 154(b) by 431 days.

(21) Appl. No.: 12/662,630

(22) Filed: Apr. 27, 2010

(65) Prior Publication Data

US 2011/0190110 A1 Aug. 4, 2011

(30) Foreign Application Priority Data

Feb. 3, 2010 (JP) ..... 2010-022391
Apr. 27, 2010 (JP) ..... 2009-108104

(51) Int. Cl.
*B31F 1/00* (2006.01)

(52) U.S. Cl.
USPC ..... 270/32; 270/39.01; 270/39.06; 270/58.07

(58) Field of Classification Search
USPC ..... 270/32, 39.01, 39.06, 39.07, 58.07; 493/424, 427, 434, 435, 442
See application file for complete search history.

(56) References Cited

U.S. PATENT DOCUMENTS 5,352,177 A * 10/1994 Walter ..... 493/23
6,042,529 A * 3/2000 Hubler et al. ..... 493/434
6,276,677 B1 * 8/2001 Hommochi et al. ..... 270/32
7,523,593 B2 * 4/2009 Aoyagi et al. ..... 53/117
7,597,311 B2 * 10/2009 Kawata et al. ..... 270/37
7,753,353 B2 * 7/2010 McNamara ..... 270/37
7,794,381 B2 9/2010 Yamamoto et al.
7,850,155 B2 * 12/2010 Mizubata et al. ..... 270/32
2006/0279035 A1 * 12/2006 Aoyagi et al. ..... 270/32
2007/0126165 A1 * 6/2007 Kawata et al. ..... 270/37
2008/0224379 A1 * 9/2008 McNamara ..... 270/58.09
2009/0062100 A1 3/2009 Takekawa et al.
2009/0129840 A1 5/2009 Takekawa et al.
2009/0189326 A1 * 7/2009 Mizubata et al. ..... 270/20.1

FOREIGN PATENT DOCUMENTS

CN 101376473 3/2009
JP 2004-099187 B 4/2004
JP 2006-062810 A 3/2006
JP 2008-024506 A 2/2008
JP 2008-247535 A 10/2008
JP 2009-029523 A 2/2009

OTHER PUBLICATIONS

Office Action dated Apr. 6, 2012 issued in corresponding Chinese Application No. 2010169404.5 and English translation thereof.

* cited by examiner

*Primary Examiner* — Leslie A Nicholson, III
(74) *Attorney, Agent, or Firm* — Harness, Dickey & Pierce P.L.C.

(57) ABSTRACT

Disclosed is a sheet processing apparatus that forms folding lines at a predetermined position of a sheet after image formation and outputs the sheet. The apparatus includes a contact unit with which a tip end or a rear end of the conveyed sheet comes into contact and by which a deflection is formed at a middle part of the sheet; folding units that form the folding lines by conveying the middle part of the sheet, at which the deflection is formed by the contact unit, between the folding units; and a deflection controlling unit that controls the deflection at the middle part of the sheet formed by the contact unit.

21 Claims, 20 Drawing Sheets

SHEET PROCESSING APPARATUS AND IMAGE FORMING APPARATUS

BACKGROUND OF THE INVENTION

1. Field of the Invention

The present invention relates to a sheet processing apparatus that performs a folding operation such as a Z-shape folding operation on a sheet ejected from an image forming apparatus like a printing apparatus. In addition, the present invention relates to the image forming apparatus equipped with the sheet processing apparatus.

2. Description of the Related Art

Up until now, a known sheet processing apparatus is included in an image forming apparatus such as a copier and a printer and performs a folding operation such as a Z-shape folding operation on a sheet on which an image has been formed by an image forming unit and the like. In such a sheet processing apparatus, a member with which the tip end or the rear end of a sheet comes into contact is provided, for example, on a conveyance path for conveying the sheet on which an image has been formed. When the sheet comes into contact with the member, a deflection is formed at the middle part of the sheet. Then, the middle part of the sheet is conveyed between rollers serving as folding units, so that folding lines are formed on the sheet.

Further, for example, Patent Document 1 discloses another method for forming folding lines on a sheet. In other words, there is provided a space in which the sheet is deflected so as to form a loop on a conveyance path, and a pressing claw is put in the loop to make the tip end of the loop mesh with a folding unit. Thus, folding lines are formed on the sheet.

However, the above methods have following drawbacks. Specifically, if there is a large distance between conveyance guide plates constituting the conveyance path provided between the folding unit and the contact member with which the tip end or the rear end of the sheet comes into contact, the deflection formed at the middle part of the sheet has a high degree of freedom. As a result, the deflection formed at the middle part of the sheet fluctuates. Thus, due to the fluctuation of the deflection formed at the middle part of the sheet, the position of the middle part of the sheet, on which folding lines have been formed by the folding unit, is shifted from an expected folding position. As a result, the folding accuracy of the sheet also fluctuates.

Further, when a folding operation is performed on the same sheet plural times, a part on which folding lines have been formed on an upstream side comes into contact with the contact member as the tip end part or the rear end part of the sheet so that the sheet has a deflection at its middle part. However, if the distance between the conveyance guide plates is large as described above, an unnecessary deflection is formed at the middle part of the sheet. As a result, the position of the folding lines formed on the upstream side is shifted from the folding position of the sheet conveyed between the folding units, which results in the occurrence of a so-called box folding phenomenon.

Patent Document 1: JP-A-2006-62810

SUMMARY OF THE INVENTION

The present invention has been made in light of the above points and may provide a sheet processing apparatus to improve the folding accuracy of a sheet and an image forming apparatus.

According to an aspect of the present invention, there is provided a sheet processing apparatus that forms folding lines at a predetermined position of a sheet after image formation and outputs the sheet. The apparatus includes a contact unit with which a tip end or a rear end of the conveyed sheet comes into contact and by which a deflection is formed at a middle part of the sheet; folding units that form the folding lines by conveying the middle part of the sheet, at which the deflection is formed by the contact unit, between the folding units; and a deflection controlling unit that controls the deflection at the middle part of the sheet formed by the contact unit.

According to another aspect of the present invention, there is provided an image forming apparatus including the sheet processing apparatus described above.

According to embodiments of the present invention, the folding accuracy of a sheet can be improved.

Other objects, features and advantages of the present invention will become more apparent from the following detailed description when read in conjunction with the accompanying drawings.

BRIEF DESCRIPTION OF THE DRAWINGS

FIGS. 11A through 11D are diagrams showing a process in which a box folding phenomenon occurs;

DETAILED DESCRIPTION OF THE PREFERRED EMBODIMENTS

Hereinafter, embodiments of the present invention are described in detail.

(Schematic Configuration of Image Forming Apparatus Equipped with Sheet Processing Apparatus)

Figure 1:
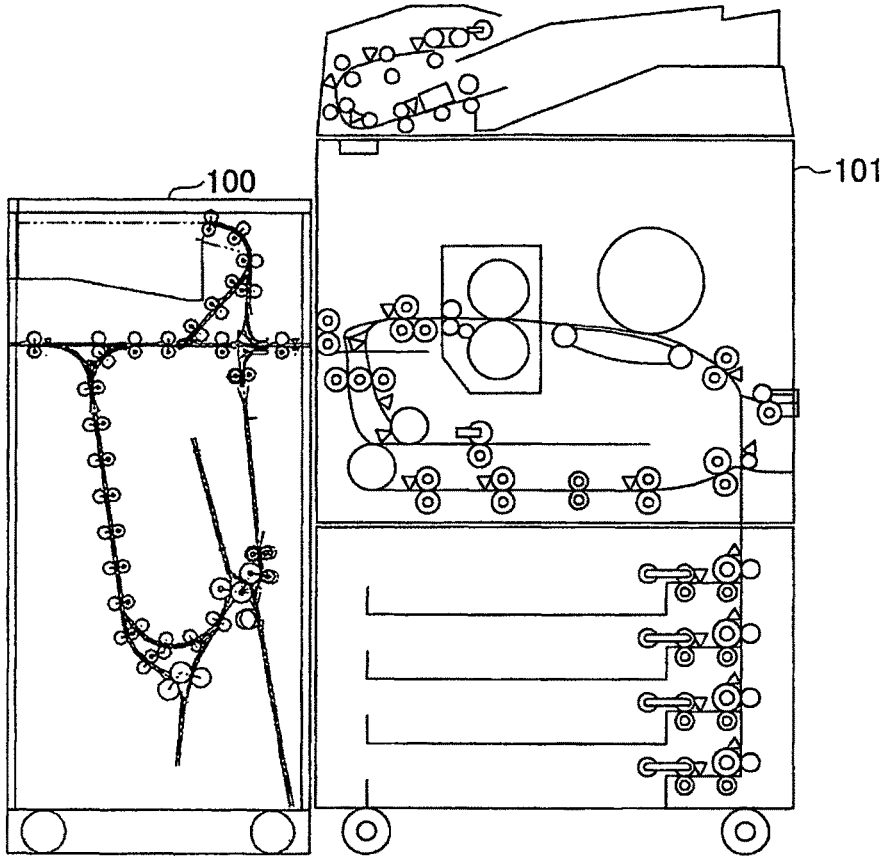
FIG. 1 is a side view showing the schematic configuration of an image forming apparatus equipped with a sheet processing apparatus according to embodiments.

FIG. 1 is a side view showing the schematic configuration of an image forming apparatus equipped with a sheet processing apparatus. As shown in FIG. 1, the sheet processing apparatus 100 according to the embodiments is externally attached to the main body of the image forming apparatus 101 such as a copier and a printer in a detachable manner and provided next to the image forming apparatus 101.

The sheet processing apparatus 100 performs a predetermined folding operation such as a Z-shape folding operation and a double folding operation on a sheet on which an image has been formed by an image forming unit and the like of the image forming apparatus 101, and then ejects the sheet to a prescribed position.

Next, the schematic configuration of the sheet processing apparatus according to the embodiments are described.

(Schematic Configuration of Sheet Processing Apparatus)

Figure 2:
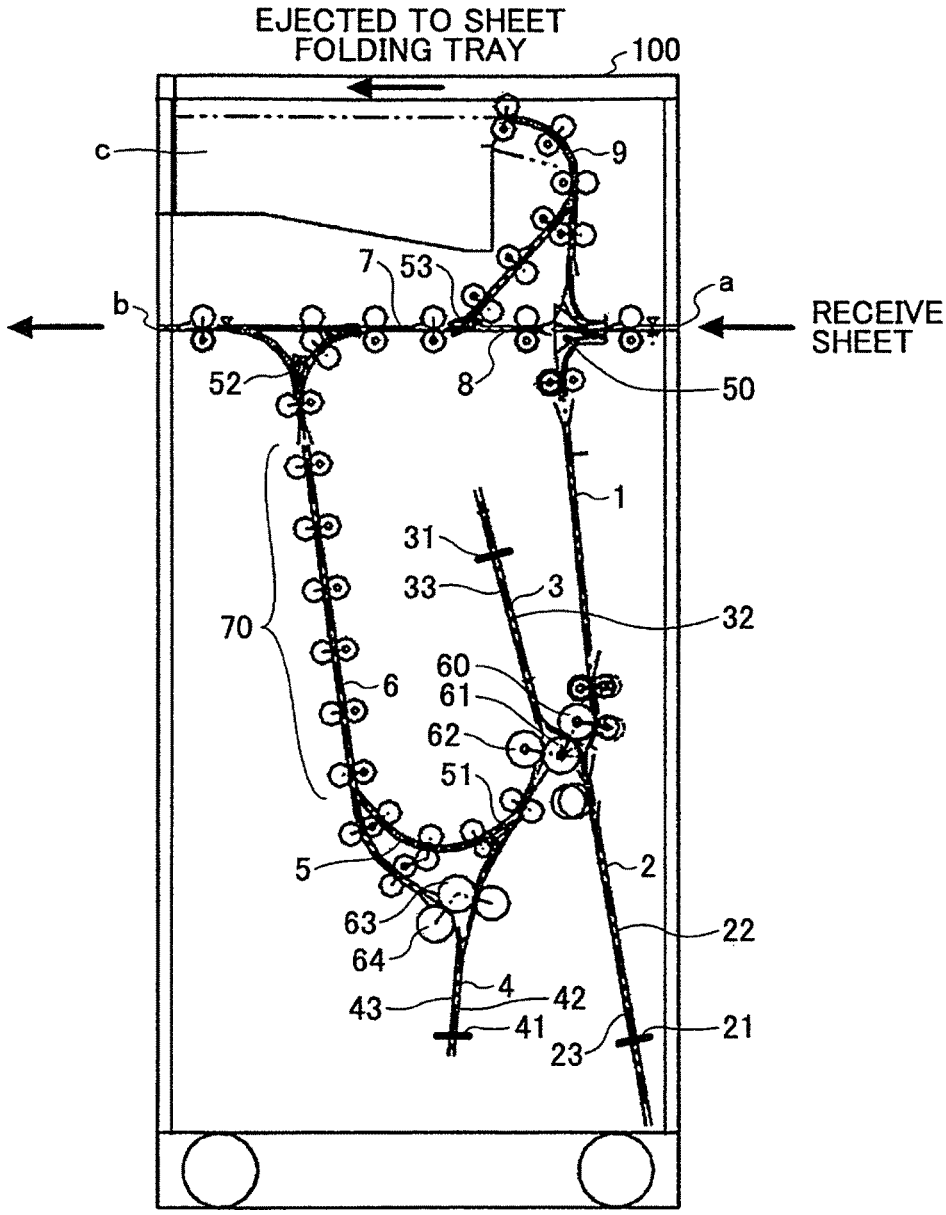
FIG. 2 is a side view showing the schematic configuration of the sheet processing apparatus according to the embodiments.

FIG. 2 is a side view showing the schematic configuration of the sheet processing apparatus according to the embodiments. As shown in FIG. 2, the sheet processing apparatus 100 receives a sheet, on which an image has been formed by the image forming unit and the like of the image forming apparatus 101, at a sheet receiving slot "a." Then, the sheet processing apparatus 100 performs a folding operation on the predetermined sheet. After that, the sheet processing apparatus 100 ejects the folded sheet from a sheet ejecting slot "b" to a post-processing apparatus when performing a post processing operation such as a punching operation and a stapling operation on the sheet involved. Otherwise, the sheet processing apparatus 100 ejects the sheet to a sheet folding tray "c" inside the sheet processing apparatus 100.

Further, the sheet processing apparatus 100 has, for example, conveyance paths 1 through 9 serving as conveyance paths for conveying the sheet to positions corresponding to places at which the folding operation is performed. Note that the conveyance paths 7 and 8 are also used for straight conveyance in which the folding operation is not performed. The conveyance paths are constructed by conveyance guide plates that guide the conveyance of the sheet, and the conveyance guide plates are provided on both sides in the thickness direction of the sheet so as to have a predetermined distance (space). Further, the conveyance paths are provided so to be connected to one another in such a manner as to be held by pairs of rollers, i.e., pairs of two folding rollers.

The conveyance paths 2, 3, and 4 have stoppers 21, 31, and 42, respectively, serving as contact units with which the tip end or the rear end of the conveyed sheet comes into contact, thereby forming a deflection in the sheet. Note that the stoppers 21, 31, and 41 are configured to be movable so as to correspond to the folding position of the sheet.

Further, the conveyance path 2 is constructed by stopper guide plates 22 and 23 serving as the conveyance guide plates that guide the conveyance of the sheet up to the stopper 21. The conveyance path 3 is constructed by stopper guide plates 32 and 33 serving as the conveyance guide plates that guide the conveyance of the sheet up to the stopper 31. The conveyance path 4 is constructed by stopper guide plates 42 and 43 serving as the conveyance guide plates that guide the conveyance of the sheet up to the stopper 41.

At connection parts of the conveyance paths 1 through 9 shown in FIG. 2, switching claws 50 through 53 that introduce the sheet into the corresponding conveyance path are provided, and folding rollers 61 through 64 serving as folding units for forming folding lines on the conveyed sheet are provided.

With the above configuration, the sheet processing apparatus 100 receives the sheet, on which an image has been formed by the image forming unit and the like of the image forming apparatus 101 on an upstream side, at the sheet receiving slot a. Then, when performing the folding operation on the sheet, the sheet processing apparatus 100 introduces the sheet onto the respective conveyance paths inside the sheet processing apparatus 100 with the switching claw 50 for the folding operation. Note that an additional-folding roller unit 70 provided on the conveyance path 6 additionally performs the folding operation on the folded sheet.

Further, with the configuration of the sheet processing apparatus 100 described above, it becomes possible to perform various folding operations, such as a Z-shape folding operation, a double folding operation, an outward triple folding operation, an inward triple folding operation, a simple quarto folding operation, and a gate folding operation, on the sheet. Note that, when not performing the folding operation on the sheet, the sheet processing apparatus 100 directly ejects the sheet conveyed via the sheet receiving slot a to the sheet ejecting slot b with the switching claw 50 so as to be conveyed into the post processing apparatus on a downstream side.

Next, specific examples of the folding operations executable by the sheet processing apparatus 100 are described below.

(Z-shape Folding Operation)

Figure 3:
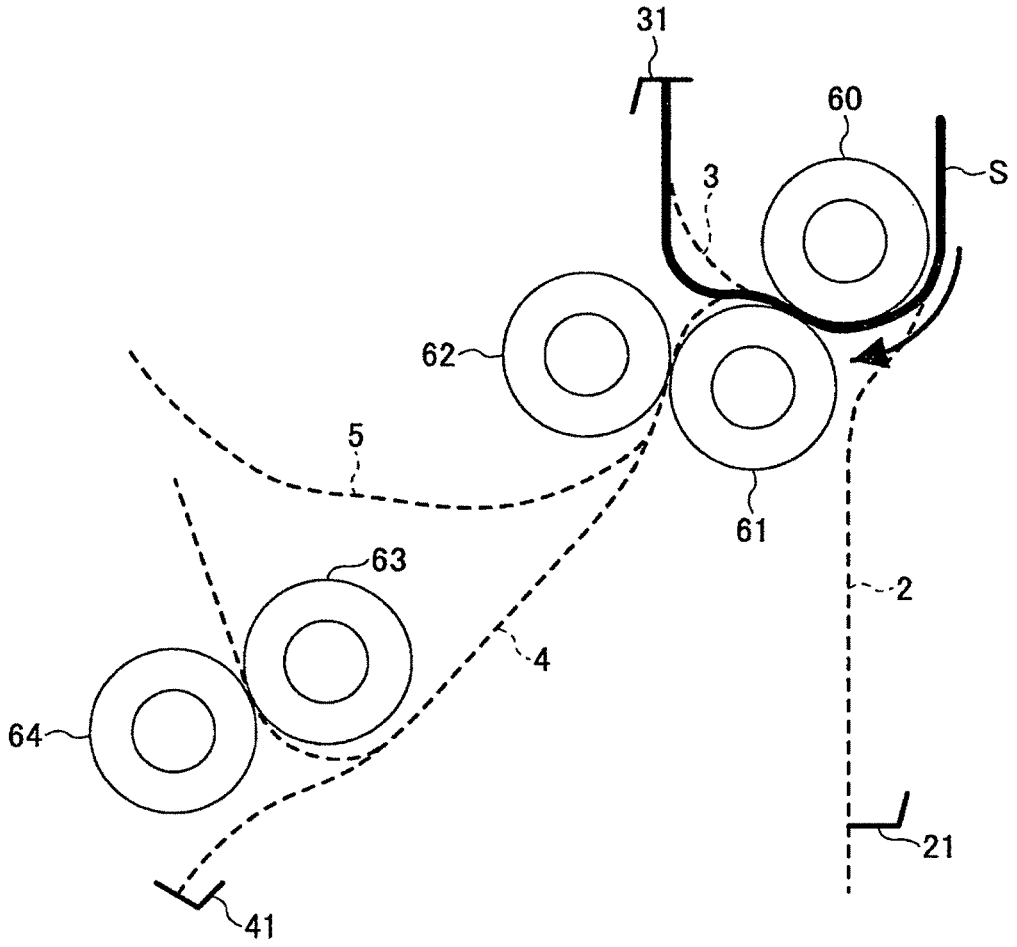
FIG. 3 is a diagram showing a state immediately before a first folding operation is performed on a sheet.
Figure 4:
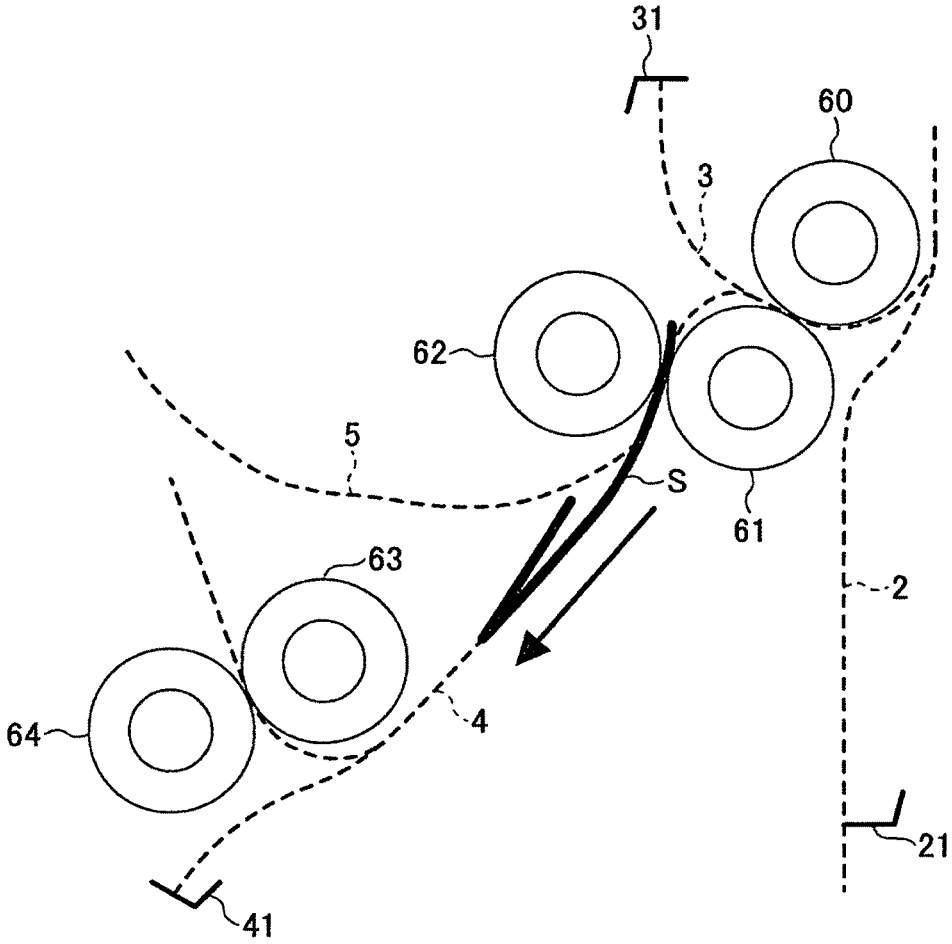
FIG. 4 is a diagram showing a state after the first folding operation is performed on the sheet.
Figure 5:
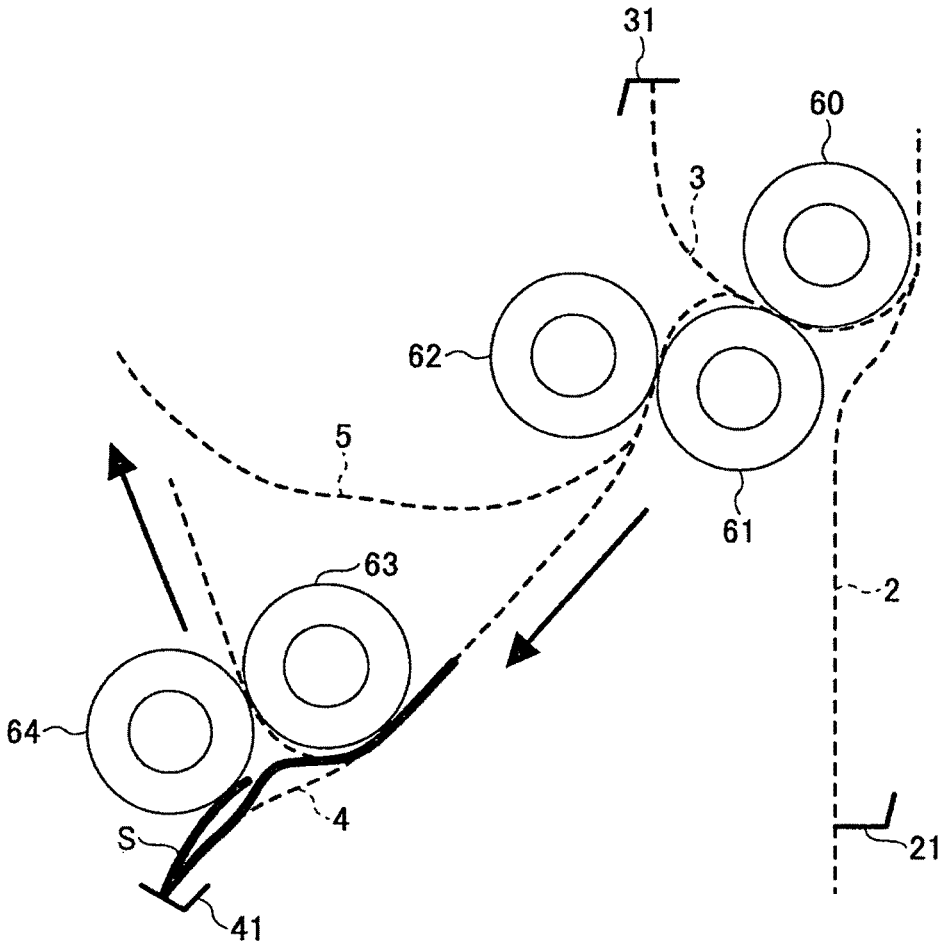
FIG. 5 is a diagram showing a state immediately before a second folding operation is performed on the sheet.
Figure 6:
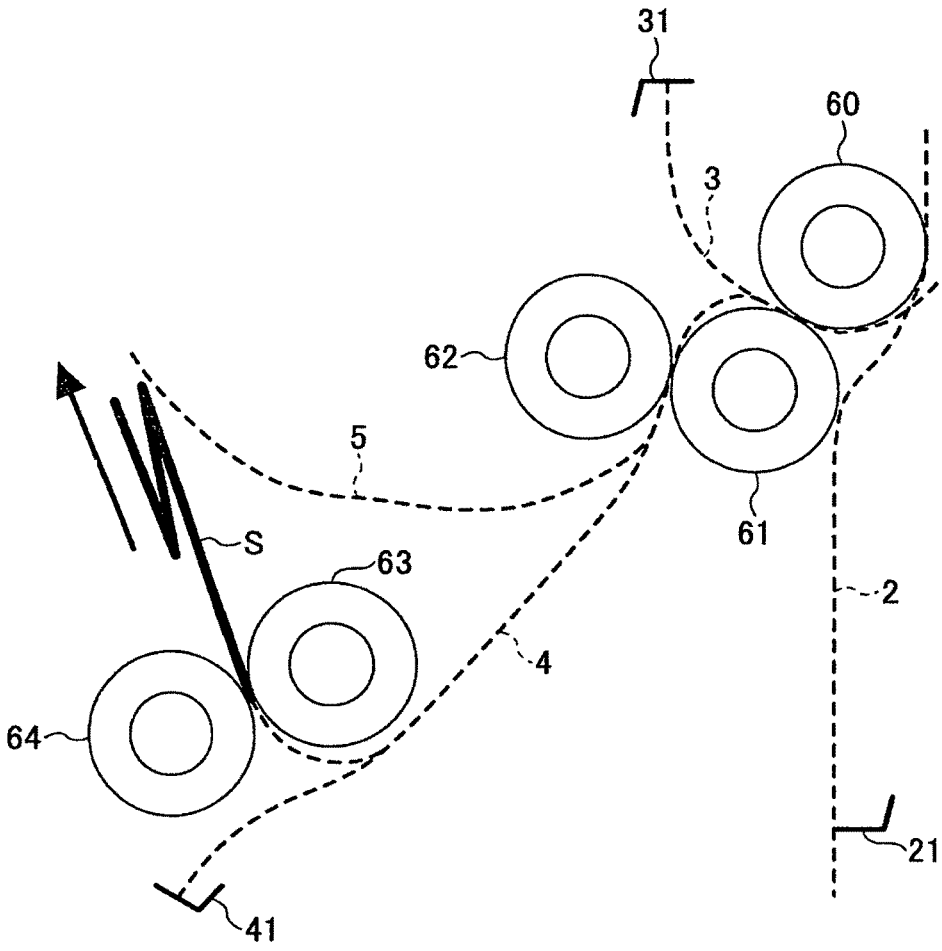
FIG. 6 is a diagram showing a state when a Z-shape folding operation is completed.

Referring first to FIGS. 3 through 6, the Z-shape folding operation according to the embodiments is described. FIG. 3 is a diagram showing a state immediately before a first folding operation is performed on the sheet. FIG. 4 is a diagram showing a state after the first folding operation is performed on the sheet. FIG. 5 is a diagram showing a state immediately before a second folding operation is performed on the sheet. FIG. 6 is a diagram showing a state when the Z-shape folding operation is completed. Note that FIGS. 3 through 6 are diagrams in which a part of the sheet processing apparatus 100 is enlarged and schematically shown.

As shown in FIG. 2, the sheet, which has been conveyed from the sheet receiving slot a as indicated by an arrow into the sheet processing apparatus 100, is guided onto the conveyance path 1 by the switching claw 50. As shown in FIG. 3, the sheet guided onto the conveyance path 1 is caused to pass through the nip of folding rollers 60 and 61 by a guide member, not shown, or the like. Here, the conveyed sheet S comes into contact with the stopper 31, which is provided on the conveyance path 3 and movable so as to correspond to a folding position, at its tip end. As a result, a deflection is formed at the middle part of the sheet S.

As shown in FIG. 4, the deflection of the sheet S formed by the processing shown in FIG. 3 moves into the nip of the folding rollers 61 and 62. Thus, the first folding operation is performed on the sheet S.

Here, the sheet S is conveyed onto the conveyance path 4 by the switching claw 51 shown in FIG. 2. Note that when moving into the nip of the folding rollers 61 and 62, the deflection formed at the middle part of the sheet S is guided to the side of the folding rollers 61 and 62 by a first turning-up prevention claw, not shown, or the like that prevents turning-up of the sheet S occurring, for example, when it is being conveyed.

Then, as shown in FIG. 5, the sheet S comes into contact with the stopper 41, which is provided on the conveyance path 4 and movable so as to correspond to a folding position, at its tip end. Thus, the sheet S has a deflection formed at its middle part. The deflection of the sheet S formed by the processing shown in FIG. 5 moves into the nip of the folding rollers 63 and 64. In this manner, the second folding operation is performed on the sheet S. As a result, the sheet S has a Z-shape folding part formed therein as shown in FIG. 6.

In the manner described above, the Z-shape folding operation is completed. Note that when moving into the nip of the folding rollers 63 and 64, the deflection formed at the middle part of the sheet S is guided to the side of the folding rollers 63 and 64 by a second turning-up prevention claw, not shown, or the like that prevents turning-up of the sheet S, for example, when it is being conveyed.

Then, the sheet S, on which the folding operation has been performed, passes through the conveyance path 6 shown in FIG. 2, is guided onto the conveyance path 7 by the switching claw 52, and is stacked on the sheet folding tray c. Note that when the sheet S is conveyed into the post-processing apparatus, it is directed by the switching claw 52.

(Double Folding Operation)

Next, the double folding operation according to the embodiments is described. The sheet, which has been conveyed from the sheet receiving slot a as indicated by the arrow in FIG. 2 into the sheet processing apparatus 100, is guided onto the conveyance path 1 by the switching claw 50. Then, when the conveyed sheet S comes into contact with the stopper 21, which is provided on the conveyance path 2 and movable so as to correspond to a folding position, at its tip end, a deflection is formed at the middle part of the sheet S. When the deflection moves into the nip of the folding rollers 60 and 61, folding lines are formed on the sheet S.

In the manner described above, the double folding operation is completed. Note that when moving into the nip of the folding rollers 60 and 61, the deflection formed at the middle part of the sheet S is guided into the nip of the folding rollers 60 and 61 by a folding blade, not shown, or the like that presses the deflection of the sheet S into the nip of the folding rollers 60 and 61. Note that it is also possible to make the deflection of the sheet S move into the nip of the folding rollers 60 and 61 without using the folding blade.

The sheet S, on which the double folding operation has been performed, is caused to pass through the nip of the folding rollers 61 and 62 by a guide member, not shown, or the like without entering the conveyance path 3, and is then guided onto the conveyance path 5 by the switching claw 51. Further, the sheet S passes through the conveyance path 6, is guided onto the conveyance path 7 by the switching claw 51, and is stacked on the sheet folding tray c. Note that when the sheet S is conveyed into the post-processing apparatus, it is directed by the switching claw 52.

(Outward Triple Folding Operation, Inward Triple Folding Operation, and Simple Quarto Folding Operation)

Next, the outward triple folding operation, the inward triple folding operation, and the simple quarto folding operation according to the embodiments are described. The sheet, which has been conveyed from the sheet receiving slot a as indicated by the arrow in FIG. 2 into the sheet processing apparatus 100, is guided onto the conveyance path 1 by the switching claw 50. Then, when the conveyed sheet S comes into contact with the stopper 21, which is provided on the conveyance path 2 and movable so as to correspond to a folding position, at its tip end, a deflection is formed at the middle part of the sheet S.

When the deflection moves into the nip of the folding rollers 60 and 61, the first folding operation is performed on the sheet S. Then, the sheet S is conveyed onto the conveyance path 3. When moving into the nip of the folding rollers 60 and 61, the deflection formed at the middle part of the sheet S is guided into the nip of the folding rollers 60 and 61 by the folding blade, not shown, or the like that presses the deflection of the sheet S into the nip of the folding rollers 60 and 61. Note that it is also possible to make the deflection of the sheet S move into the nip of the folding rollers 60 and 61 without using the folding blade.

Then, when the sheet S comes into contact with the stopper 31, which is provided on the conveyance path 3 and movable so as to correspond to a folding position, at its tip end, a deflection is formed at the middle part of the sheet S. The deflection of the sheet S moves into the nip of the folding rollers 61 and 62. Thus, the second folding operation is performed on the sheet S. Note that when moving into the nip of the folding rollers 61 and 62, the deflection formed at the middle part of the sheet S is guided to the side of the folding rollers 61 and 62 by the first turning-up prevention claw, not shown, or the like. Thus, the folding operation on the sheet S is completed.

Note that the outward triple folding operation, the inward triple folding operation, and the simple quarto folding operation are almost the same except for a position at which the sheet S is folded for the first time. The folding position of the sheet S is adjusted by changing the position of the stopper 21. The folding position of the sheet S for the second time is determined based on the position of the sheet S folded for the first time. In accordance with the folding positions thus determined, the first and second folding operations are performed on the sheet S.

Particularly, in the case of the inward triple folding operation, when the deflection formed in the sheet S moves into the nip of the folding rollers 61 and 62, the tip end of the sheet S folded for the first time is guided by, for example, the first turning-up prevention claw, not shown, or the like so as to move into the nip of the folding rollers 60 and 61.

Then, the sheet S, on which the above folding operation has been performed, is guided onto the conveyance path 5 by the switching claw 51, passes through the conveyance path 6, is guided onto the conveyance path 7 by the switching claw 52, and is stacked on the sheet folding tray c. Note that when the sheet S is conveyed into the post-processing apparatus, it is directed by the switching claw 52.

(Gate Folding Operation)

Next, the gate folding operation according to the embodiments is described. The sheet, which has been conveyed from the sheet receiving slot a as indicated by the arrow in FIG. 2 into the sheet processing apparatus 100, is guided onto the conveyance path 1 by the switching claw 50. Then, when the conveyed sheet S comes into contact with the stopper 21, which is provided on the conveyance path 2 and movable so as to correspond to a folding position, at its tip end, a deflection is formed at the middle part of the sheet S.

When the deflection moves into the nip of the folding rollers 60 and 61, the first folding operation is performed on the sheet S. Then, the sheet S is conveyed onto the conveyance path 3. When moving into the nip of the folding rollers 60 and 61, the deflection formed at the middle part of the sheet S is guided into the nip of the folding rollers 60 and 61 by the folding blade, not shown, or the like. Note that it is also possible to make the deflection of the sheet S move into the nip of the folding rollers 60 and 61 without using the folding blade.

Then, when the sheet S comes into contact with the stopper 31, which is provided on the conveyance path 3 and movable so as to correspond to a folding position, at its tip end, a deflection is formed at the middle part of the sheet S. The deflection formed at the sheet S moves into the nip of the folding rollers 61 and 62. Thus, the second folding operation is performed on the sheet S. After this, the sheet S is conveyed onto the conveyance path 4 by the switching claw 51.

At this time, the deflection of the sheet S is guided to the folding rollers 61 and 62 by, for example, the first turning-up prevention claw, not shown, or the like, and the tip end of the sheet S folded for the first time is guided into the nip of the folding rollers 61 and 62 by the first turning-up prevention claw, and the like. Then, when the conveyed sheet S comes into contact with the stopper 41, which is provided on the conveyance path 4 and movable so as to correspond to a folding position, at its tip end, a deflection is formed at the middle part of the sheet S.

When the deflection formed at the middle part of the sheet S moves into the nip of the folding rollers 63 and 64, a third folding operation is performed on the sheet S. Thus, the gate folding operation is completed. At this time, when the deflection of the sheet S is guided into the nip of the folding rollers 63 and 64 by the second turning-up prevention claw, not shown, or the like, and the tip ends of the sheet S folded for the first and second times are guided so as to move into the nip of the folding rollers 63 and 64.

Then, the sheet S, on which the above folding operation has been performed, passes through the conveyance path 6, is guided onto the conveyance path 7 by the switching claw 52, and is stacked on the sheet folding tray c. Note that when the sheet S is conveyed into the post-processing apparatus, it is directed by the switching claw 52.

(Deflection of Sheet Formed on General Conveyance Path)

Figure 7:
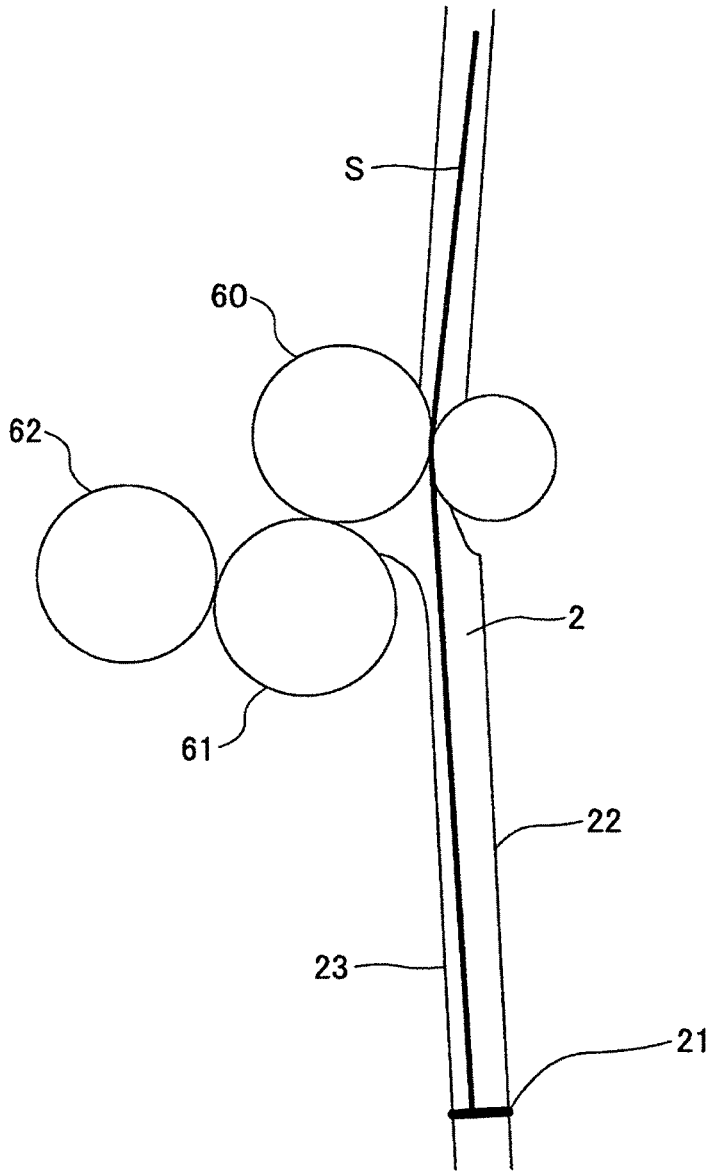
FIG. 7 is a diagram showing a state when the sheet just comes into contact with a stopper at its tip end.

Here, a description is made of a deflection formed when the sheet comes into contact with the stopper at its tip end on a general conveyance path. FIG. 7 is a diagram showing a state when the sheet just comes into contact with the stopper at its tip end.

As shown in FIG. 7, the conveyance path 2 is provided between the stopper 21 and the folding rollers 60 and 61. Further, the conveyance path 2 is constructed by stopper guide plates 22 and 23 serving as the conveyance guide plates and configured to have a predetermined space where the sheet S is conveyed. Further, FIG. 7 shows an example in which the sheet S is conveyed onto the conveyance path 2 and just comes into contact with the stopper 21 at its tip end.

Figure 8:
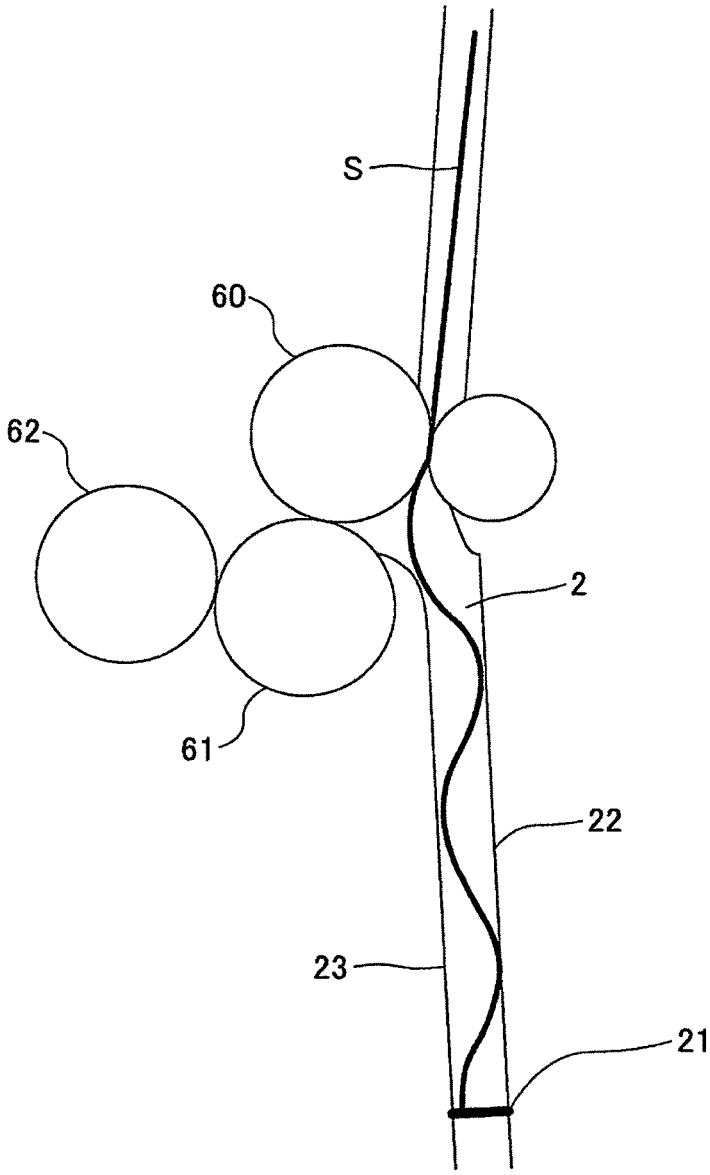
FIG. 8 is a diagram showing a state when the sheet has a deflection at its middle part with the tip end having come into contact with the stopper on a conveyance path shown in FIG. 7.

FIG. 8 is a diagram showing a state when the sheet S has a deflection at its middle part with the tip end come into contact with the stopper on the conveyance path 2 shown in FIG. 7. As shown in FIG. 8, if there is a large distance between the stopper guide plates 22 and 23 constructing the conveyance path 2 provided between the stopper 21 and the folding rollers 60 and 61, the deflection formed at the middle part of the sheet has a high degree of freedom.

If the deflection formed at the middle part of the sheet S has a high degree of freedom, the sheet S is allowed to be deflected in a manner as shown in FIGS. 7 and 8. As a result, the deflection formed at the middle part of the sheet S fluctuates. Thus, due to the fluctuation of the deflection formed at the middle part of the sheet S, the position of the middle part of the sheet S, which moves into the nip of the folding rollers 60 and 61, is shifted from an expected folding position. As a result, the folding accuracy of the sheet S also fluctuates.

Figure 9:
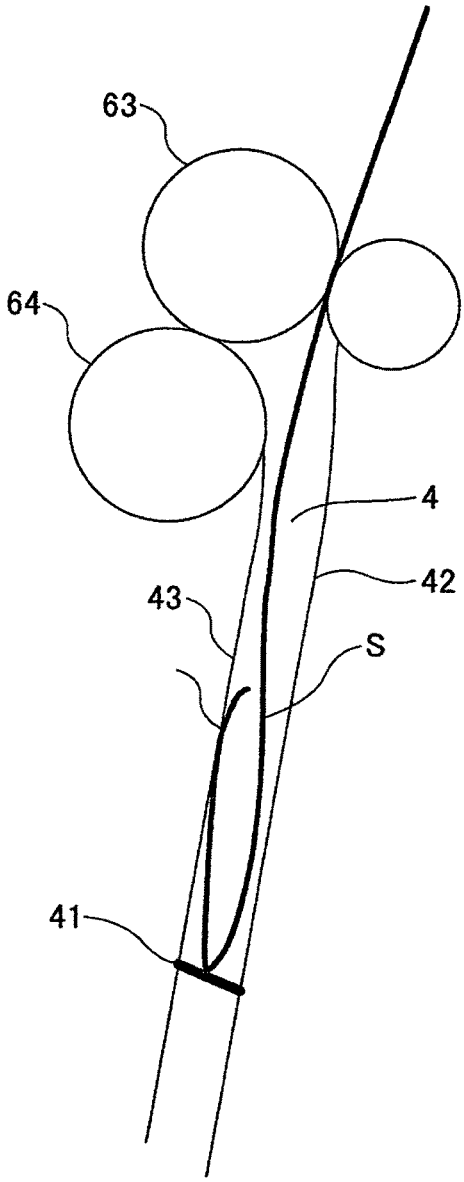
FIG. 9 is a diagram showing a state when the sheet just comes into contact with the stopper at its tip end.

Next, a description is made of a deflection formed when the sheet S is folded plural times in the sheet processing apparatus 100 as in the case of the Z-shape folding operation. That is, the deflection formed when the sheet S is folded for the second or subsequent times is described. FIG. 9 is a diagram showing a state when the sheet S just comes into contact with the stopper at its tip end.

As shown in FIG. 9, the conveyance path 4 is provided between the stopper 41 and the folding rollers 63 and 64. Further, the conveyance path 4 is constructed by the stopper guide plates 42 and 43 and configured to have a predetermined space where the sheet S, on which the folding lines have been formed on the upstream side, is conveyed. FIG. 9 shows a state in which the sheet S just comes into contact with the stopper 41 at the part of the folding lines serving as its tip end.

Figure 10:
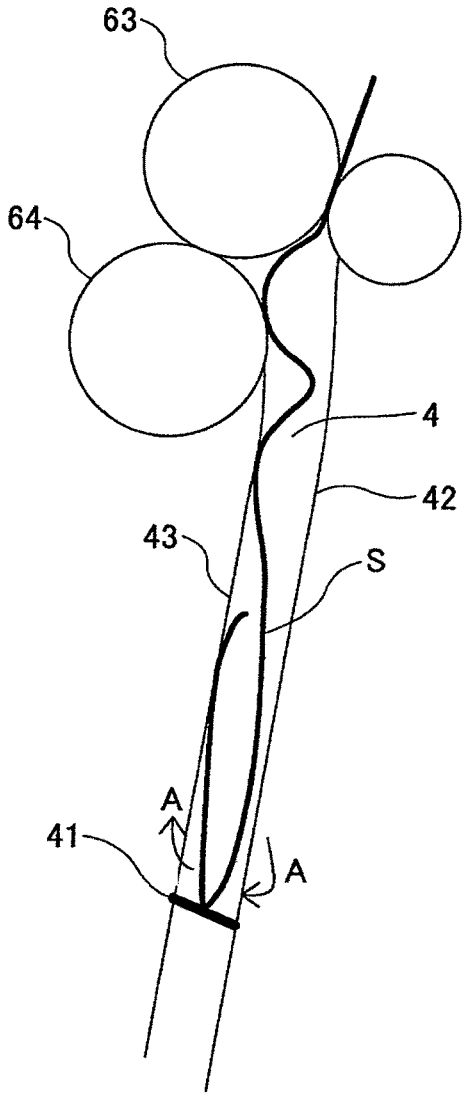
FIG. 10 is a diagram showing a state when the sheet has a deflection formed at its middle part with the tip end having come into contact with the stopper on the conveyance path shown in FIG. 9.

FIG. 10 is a diagram showing a state when the sheet S has a deflection formed at its middle part with the tip end come into contact with the stopper 41 on the conveyance path 4 shown in FIG. 9. As shown in FIG. 10, if there is a large distance between the stopper guide plates 42 and 43 when the sheet S comes into contact with the stopper 41 at the part of the folding lines serving as its tip end, an unnecessary deflection is formed at the middle part of the sheet S between the stopper guide plates 42 and 43.

When the sheet S is conveyed between the folding rollers 63 and 64 with the unnecessary deflection formed at the middle part of the sheet S between the stopper guide 42 and 43, the folding position of the sheet S folded for the first time is moved in the direction as indicated by arrows A. As a result, a box folding phenomenon, in which new folding lines are formed at a position shifted from the folding position of the sheet S folded for the first time, occurs.

Here, the box folding phenomenon is specifically described. FIGS. 11A through 11D are diagrams showing a process in which the box folding phenomenon occurs. That is, the box folding phenomenon occurs in the sheet S in the order from FIGS. 11A through 11D.

Figure 11A:
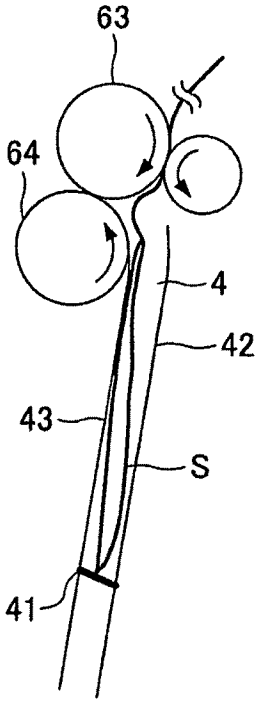
Figure 11B:
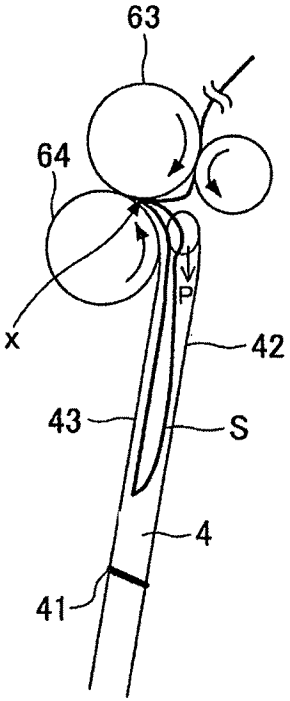

As shown in FIG. 11A, the sheet S comes into contact with the stopper 41 at the part, on which the folding lines have been formed on the upstream side, serving as its tip end. Here, the deflection formed at the sheet S is conveyed between the folding rollers 63 and 64. At this time, the unnecessary deflection of the sheet S surrounded by a circle in FIG. 11B is moved in the direction as indicated by an arrow P when the sheet S is conveyed between the folding rollers 63 and 64. Further, when the sheet S is folded for the second time, the tip end x of the sheet S is conveyed between the folding rollers 63 and 64.

Figure 11C:
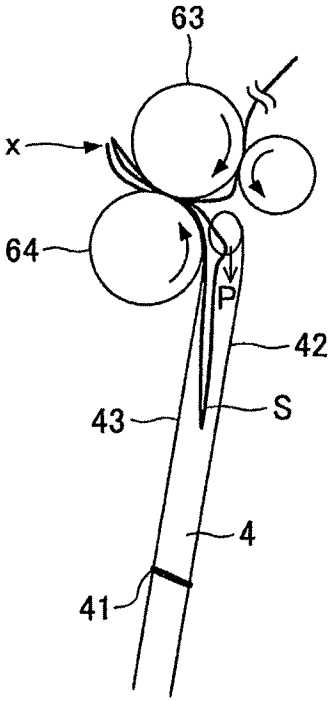

Then, as shown in FIG. 11C, when the sheet S is further conveyed between the folding rollers 63 and 64, the unnecessary deflection of the sheet S surrounded by the circle is also further conveyed in the direction as indicated by the arrow P. In addition, when the sheet S is conveyed between the folding rollers 63 and 64, new folding lines are formed at the middle part of the unnecessary deflection as indicated by an arrow y shown in FIG. 11D. At the same time, the folding position at which the folding-lines have been formed for the first time is moved in the direction as indicated by an arrow A. As a result, the second folding lines are formed around the folding position at which the folding lines have been formed for the first time.

Figure 12:
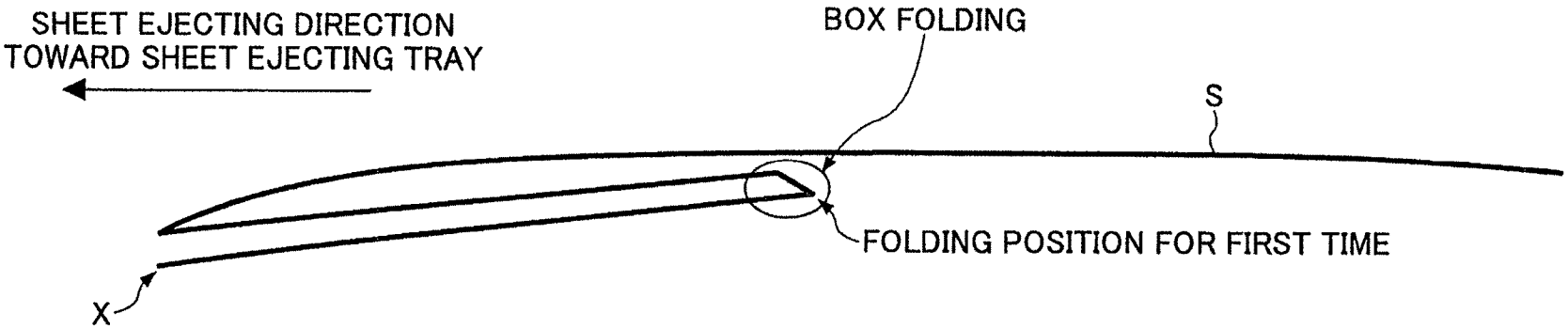
FIG. 12 is a diagram showing the finished Z-shape sheet in which the box folding phenomenon occurs.

FIG. 12 is a diagram showing the finished Z-shape sheet S in which the box folding phenomenon occurs. As shown in FIG. 12, the new folding lines are formed around the position at which the folding lines have been formed on the sheet S for the first time, whereby the box folding phenomenon occurs.

(Deflection Controlling Unit)

First Embodiment

Figure 13:
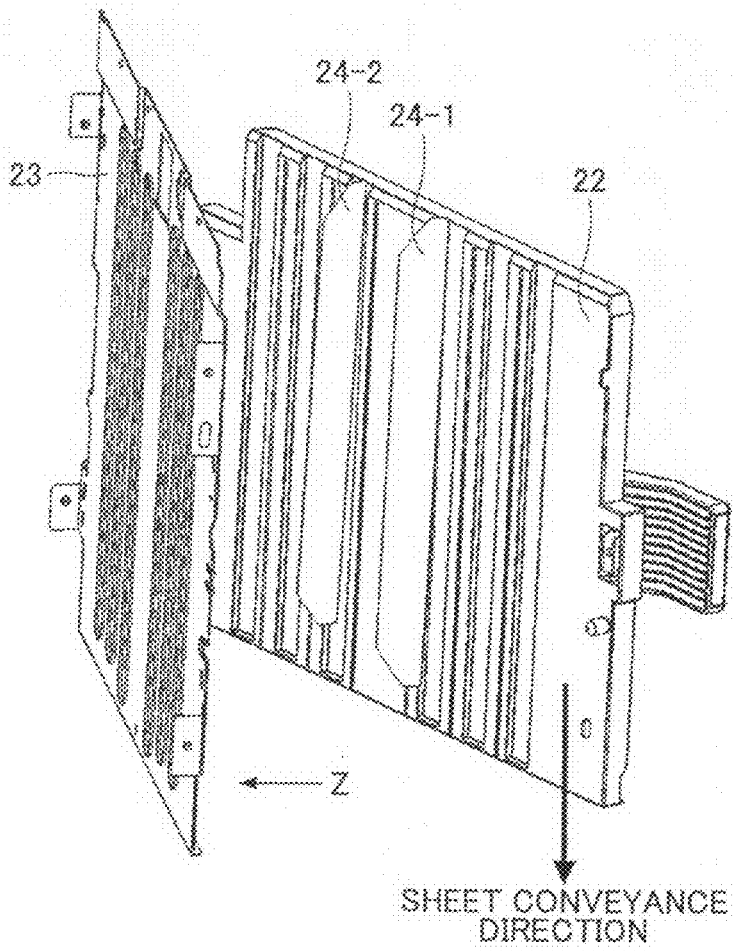
FIG. 13 is a diagram showing the conveyance path, which is provided between the stopper serving as a contact unit with which the tip end or the rear end of the conveyed sheet comes into contact and folding rollers serving as folding units.

Next, a deflection controlling unit according to the embodiments is described. FIG. 13 is a diagram showing the conveyance path, which is provided between the stopper serving as the contact unit with which the tip end or the rear end of the conveyed sheet comes into contact and the folding rollers serving as the folding units.

As shown in FIG. 13, the conveyance path 2, which is provided between the stopper serving as the contact unit with which the tip end or the rear end of the conveyed sheet comes into contact and the folding rollers serving as the folding units, is configured to have a predetermined space with the stopper guide plates 22 and 23 serving as the conveyance guide plates.

At the sheet conveyance surface of the stopper guide plate 22 constituting the conveyance path, mylars 24 that are elastic substances having a smooth front surface and made of, for example, a plate-like member are attached as the deflection controlling units. For example, the mylars 24 are plate members formed of resin or the like.

On the other hand, at the parts of the sheet conveyance surface of the stopper guide plate 23 corresponding to the mylars, grooves or through-holes are formed.

Figure 14:
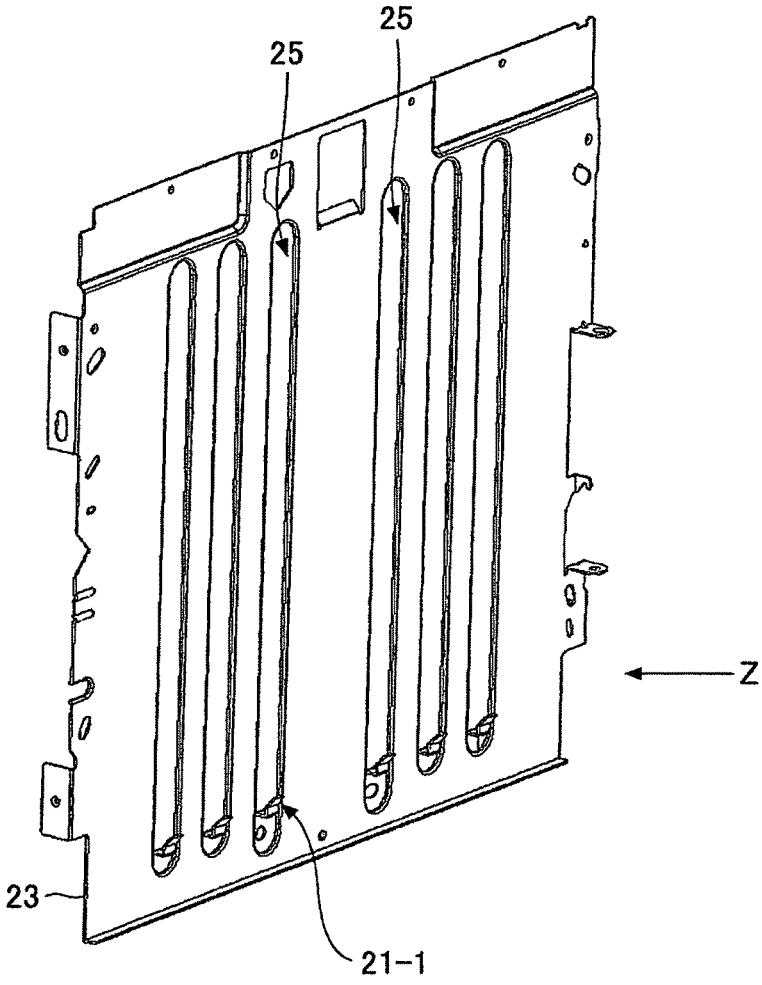
FIG. 14 is a diagram showing the stopper guide plate having through-holes as seen from the side of mylars.

FIG. 14 is a diagram showing the stopper guide plate 23 having the through-holes as seen from the side of the mylars 24. As shown in FIG. 14, when the stopper guide plate 23 of FIG. 13 is seen from the side of the mylars 24 in the direction as indicated by an arrow z, stopper claws 21-1 serving as the stoppers, with which the tip end of the sheet comes into contact, are provided in the stopper guide plate 23. Further, the through-holes 25, in which the mylars 24 of the stopper guide plate 22 are inserted, are formed in the stopper guide plate 23. The mylars 24 are inserted in the through-holes 25 so as not to interfere with the stopper claws 21-1.

Thus, when the mylars 24 are inserted in the through-holes 25, grooves, or the like of the stopper guide plate 23, they are provided so as to overlap the opposing stopper guide plate 23. Note that since the mylars 24 are, for example, thin, and poor in strength due to their low elasticity, the sheet on the conveyance path can enter a space between the mylars 24 and the stopper guide plate 23.

Further, as shown in FIG. 13, the mylars 24 are composed of, for example, two mylars 24-1 and 24-2, and provided in a partial range on the stopper guide plate 22 along the sheet conveyance direction. Here, the mylars 24-1 and 24-2 are provided symmetrically with respect to the center of the conveyed sheet.

Further, as described below, when the stopper guide plate 22 is seen in plan view, the mylars 24-1 and 24-2 may be provided in an inverted V-shape such that an interval between the mylars gets gradually smaller from the upstream side to the downstream side of the conveyance path where the sheet is conveyed. Moreover, the number of the mylars 24 is not limited to two, but the mylars 24 may be composed of three or more mylars. For example, another mylar may be provided at the center of the conveyance path other than the two mylars described above. In addition, plural mylars, i.e., two mylars, may be each provided symmetrically with respect to the center of the conveyance path.

Further, if the mylars 24 are made of conductive resin such as polyester elastomer, they may also serve as a static electricity removing unit that removes static electricity at the closed surface of the sheet just before the sheet is folded and conveyed by the folding rollers.

Further, the tip ends of the maylars 24 on the upstream side of the conveyance path where the sheet is conveyed are shaped such that the tip ends are distant from the opposing stopper guide plate 23 at the most upstream position of the tip ends, and come closer to the stopper guide plate 23 and finally make contact therewith on the downstream side of the conveyance path.

Note that the conveyance path 3, 4, or the like may have the same configuration as that of the conveyance path 2.

Next, a description is made of the deflection, folding accuracy, or the like of the sheet S conveyed through the conveyance path according to the first embodiment shown in FIG. 13.

(Improvement in Folding Accuracy)

Figure 15:
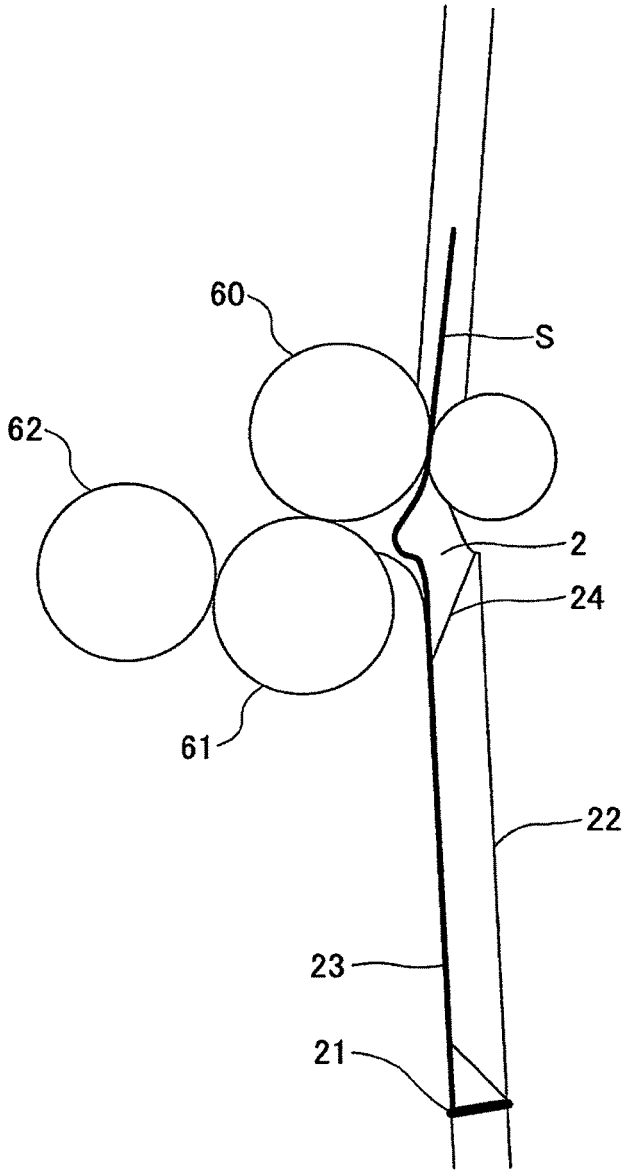
FIG. 15 is a diagram showing a state immediately after the sheet comes into contact with the stopper at its tip end on the conveyance path where the mylars are provided.

FIG. 15 is a diagram showing a state immediately after the sheet S comes into contact with the stopper 21 at its tip end on the conveyance path where the mylars are provided. As shown in FIG. 15, when the sheet S, which is placed between the stopper guide plates 22 and 23, comes into contact with the stopper 21 at its tip end, it is pressed against the stopper guide plate 23.

Thus, a deflection is not formed in the sheet S within a sheet conveyance region where the mylars 24 are provided, but is formed only at a position right above the nip of folding rollers 60 and 61. Accordingly, the fluctuation of the deflection formed in the sheet S between the stopper guide plates 22 and 23 is reduced, and the sheet S is conveyed between the folding units at an expected folding position to have folding lines formed thereon. Therefore, the folding position of the sheet S is not shifted. As a result, it is possible to improve the folding accuracy of the sheet S ejected from the sheet processing apparatus 100. The folding accuracy of the sheet S is also improved on the conveyance paths 3 and 4.

Note that in the above embodiment, the deflection is formed in the sheet S when the sheet comes into contact with the stopper 21 at its tip end. However, the embodiment of the present invention is not limited to this. For example, a deflection can be formed in the sheet S when the rear end of the sheet S comes into contact with a stopper that is movable in accordance with a folding position.

(Prevention of Box Folding Phenomenon)

Figure 16:
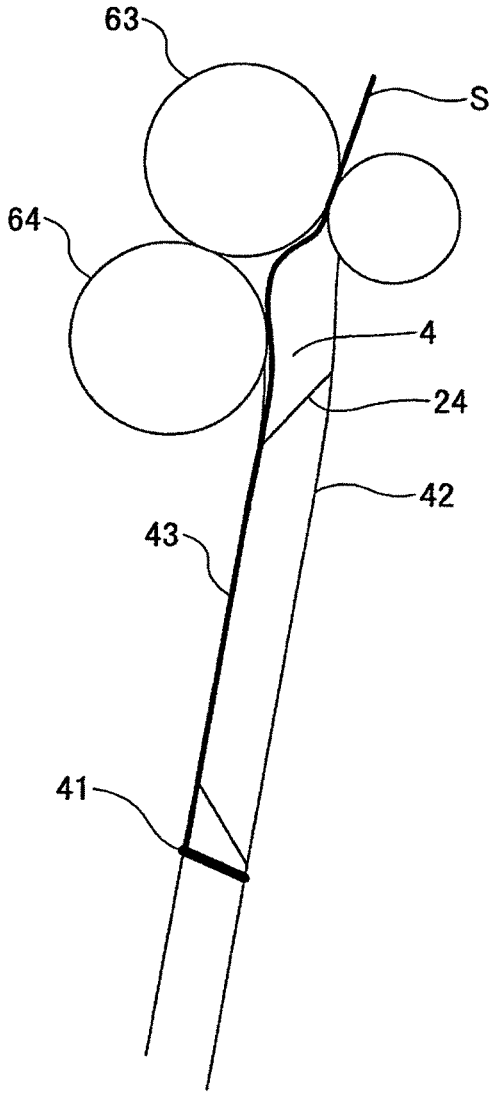
FIG. 16 is a diagram showing a state immediately before a Z-shape folding part is formed in the sheet for the second time.

FIG. 16 is a diagram showing a state immediately before a Z-shape folding part is formed in the sheet S for the second time. As shown in FIG. 16, immediately after the tip end of the folding part of the sheet S formed for the first time comes into contact with the stopper 41, the sheet S placed between the stopper guide plates 42 and 43 constituting the conveyance path 4 is pressed against the stopper guide plate 43 by the mylars 24.

Thus, an unnecessary deflection is not formed in the sheet S between the stopper guide plates 42 and 43 within a sheet conveyance region where the mylars 24 are provided, but it is formed only at a position right above the nip of folding rollers 63 and 64.

Accordingly, even after the deflection of the sheet S is conveyed between the nip of the folding rollers 63 and 64, the position of the folding part of the sheet S formed for the first time, which is indicated by an arrow A in FIG. 10, is not shifted. As a result, it is possible to prevent the occurrence of the box folding phenomenon in which the position of folding lines formed on the sheet S for the first time is shifted from the folding position of the sheet S conveyed between the folding units.

(Prevention of Wrinkles)

Figure 17:
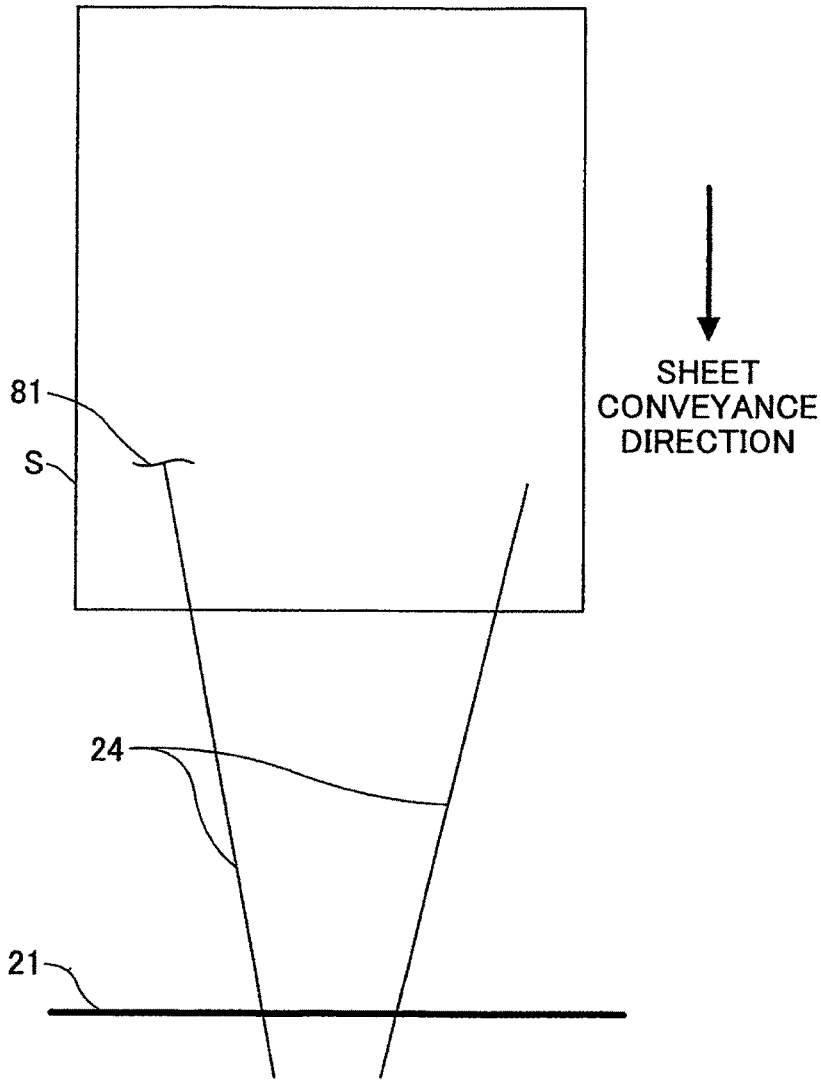
FIG. 17 is a plan view showing a state when the sheet enters the conveyance path where the mylars are provided.
Figure 18:
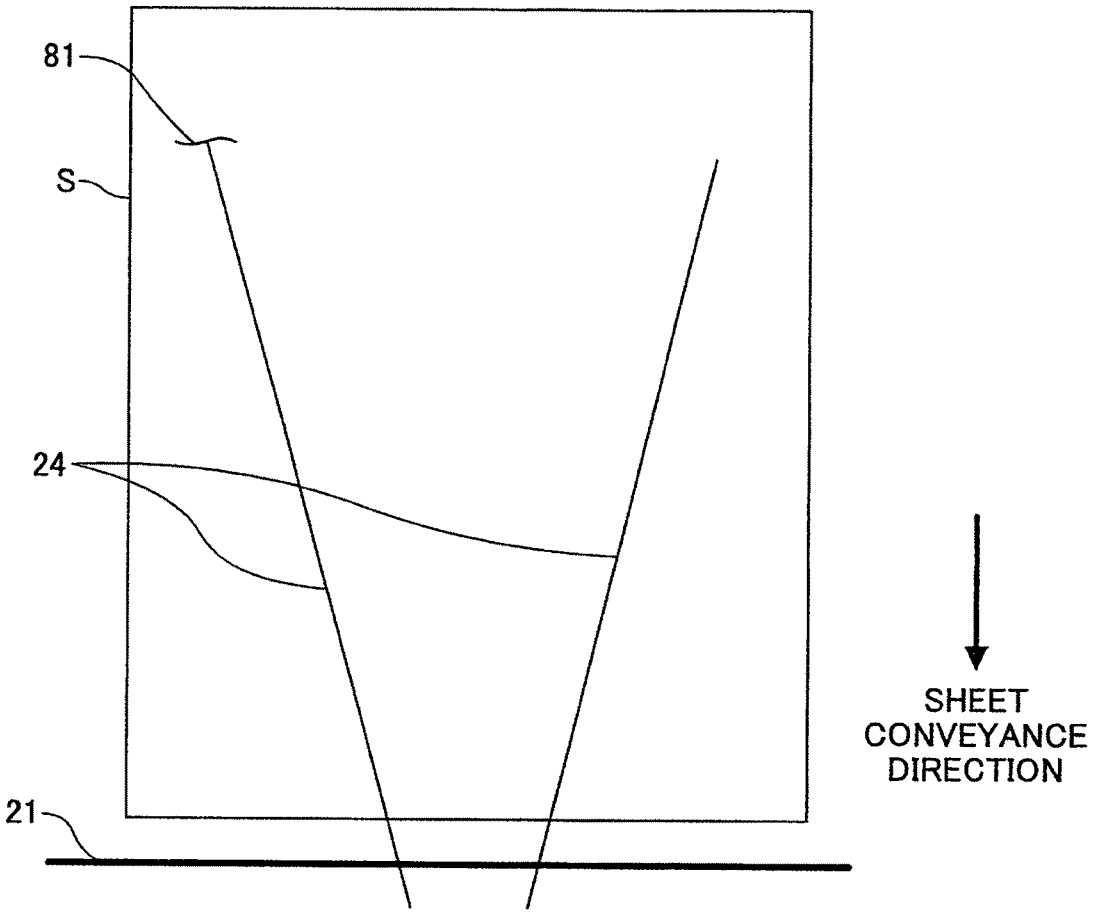
FIG. 18 is a diagram showing a state immediately before the sheet comes into contact with the stopper on the conveyance path where the mylars are provided.

Next, a description is made of a state until the sheet S comes into contact with the stopper 21 on the conveyance path where the mylars 24 are provided. FIG. 17 is a plan view showing a state when the sheet S enters the conveyance path where the mylars are provided. FIG. 18 is a diagram showing a state immediately before the sheet S comes into contact with the stopper on the conveyance path where the mylars are provided.

As shown in FIG. 17, with the provision of the mylars 24 between the conveyance guide plates (for example, between the stopper guide plates 22 and 23), a space between the conveyance guide plates is narrowed to eliminate a gap. Therefore, in this case, when the sheet S poor in strength such as a thin paper moves to the mylars 24, a dilation 81 may be generated at the front surface of the sheet S.

When the sheet S poor in strength moves into the space between the conveyance guide plates in contact with the mylars 24 in the direction as indicated by an arrow in FIG. 17, there is a concern that the dilation 81 is generated at the front surface of the sheet S to cause wrinkles on the sheet S.

However, as shown in FIG. 17, the two mylars 24 composed of the mylars 24-1 and 24-2 are provided in an inverted V-shape such that an interval between the mylars gets gradually smaller from the upstream side to the downstream side of the conveyance path where the sheet S is conveyed.

Thus, even if the dilation 81 is generated at the front surface of the sheet S, it is stretched to the side of the rear end of the sheet S or the sides of the left and right ends of the sheet S as the sheet S is conveyed toward the stopper 21 in the direction as indicated by an arrow in FIG. 18. Accordingly, wrinkles occurring at the front surface of the sheet S caused by the dilation of the sheet S are prevented. As a result, even if a thin paper is used as described above, it is possible to prevent the occurrence of wrinkles on the paper.

Note that the same effect as the above can be obtained if the conveyance paths 3 and 4 are provided with the same configuration.

(Prevention of Jam)

Figure 19:
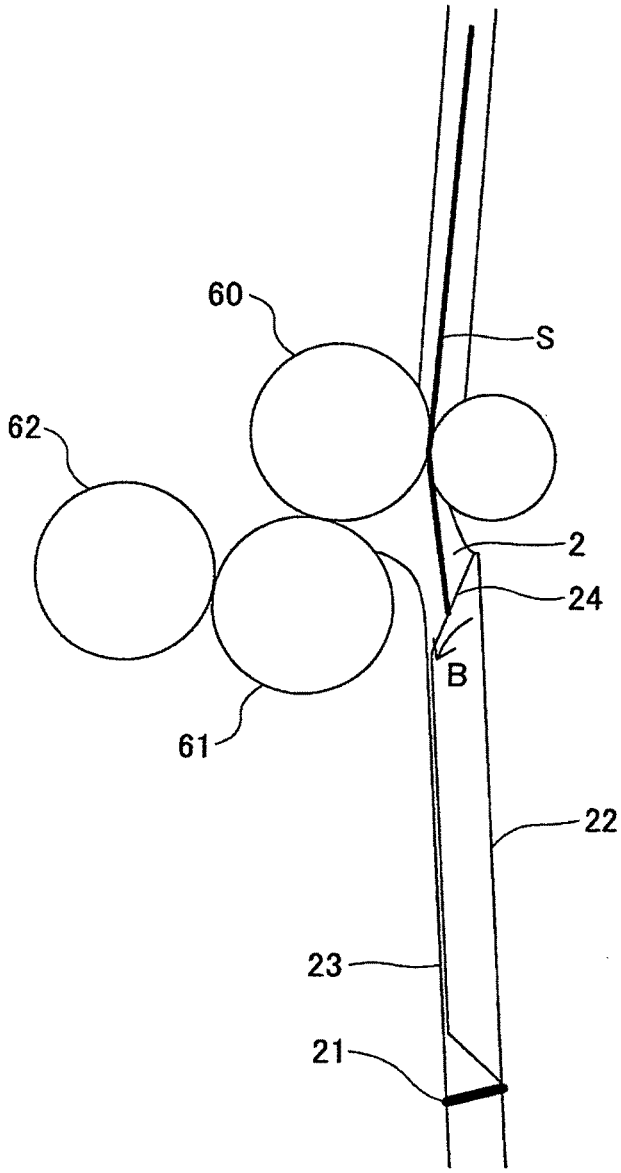
FIG. 19 is a diagram showing the state when the sheet moves to the upstream side of the mylars on the conveyance path.

Next, a description is made of a state when the sheet S moves to the upstream side of the mylars 24. FIG. 19 is a diagram showing the state when the sheet S moves to the upstream side of the mylars 24 on the conveyance path. As shown in FIG. 19, the mylars 24 provided on the conveyance path have an inclination on the upstream side of the conveyance path when seen from the side of the mylars 24.

In other words, the tip ends of the maylars 24 on the upstream side of the conveyance path where the sheet is conveyed are shaped such that the tip ends are distant from the opposing stopper guide plate 23 at the most upstream position of the tip ends, and come closer to the stopper guide plate 23 and finally make contact therewith on the downstream side of the conveyance path. Accordingly, the mylars 24 are shaped in such a manner as to guide the conveyed sheet S in the direction as indicated by an arrow B shown in FIG. 19.

Thus, even when the conveyed sheet S comes into contact with the mylars 24 at its tip end, the tip end of the sheet S is guided in the direction as indicated by the arrow B shown in FIG. 19. Accordingly, even where the sheet S poor in strength such as a thin paper comes into contact with the mylars 24 at its tip end, it is possible to prevent the occurrence of jam due to the buckled sheet S. Note that the same effect as the above can be obtained if the conveyance paths 3 and 4 are provided with the same configuration as the above.

As described above, according to the first embodiment, the elastic substances (elastic members) such as the mylars 24 are provided on the conveyance guide plate between the folding units and the contact unit with which the sheet S comes into contact. In other words, with the simpler configuration and at low cost, the distance between the conveyance guide plates is narrowed so as to control the deflection of the sheet S formed when the conveyed sheet S comes into contact with the contact unit at its tip end or rear end. Thus, the sheet S is conveyed between the folding units at an expected folding position, whereby folding lines are formed on the sheet S without being shifted. As a result, it is possible to improve the folding accuracy of the sheet S to be ejected.

Further, even when the sheet S is folded for the second or subsequent times, the folding position of the sheet S on which folding lines have been formed on the upstream side is not shifted from the folding position of the sheet S conveyed between the folding units, thus making it possible to appropriately reduce the box folding phenomenon.

Further, if the elastic substance such as the mylar 24 is provided in one of the pair of conveyance guide plates, one of the conveyance guide plates, which is provided between the folding units and the contact unit with which the sheet S comes into contact, is constituted by a resin member or a metal member having rigidity. Thus, it is possible to narrow the distance between the conveyance guide plates without degrading conveyance quality.

Further, as in the case described above, when the elastic substances such as the mylars 24 are inserted in the grooves formed in the conveyance guide plates to eliminate a gap between the conveyance guide plates and the elastic substances, it is possible to prevent an unnecessary deflection from being formed in the sheet S between the conveyance guide plates, reduce the fluctuation of the deflection of the sheet S, and improve the folding accuracy of the sheet S to be ejected.

Further, since the elastic substances such as the mylars 24 are symmetrically provided on the conveyance guide plate with respect to the center of the conveyed sheet S, it is possible to prevent a skew (inclination of the sheet S) occurring when the sheet S moves to the conveyance guide plates.

Further, the elastic substances such as the mylars 24 provided on the conveyance guide plate are arranged in an inverted V-shape from the upstream side to the downstream side of the conveyance path where the sheet is conveyed. Therefore, even if a dilation is generated at the tip end of the sheet S when the tip end of the conveyed sheet S moves to the mylars 24, it is stretched to the side of the rear end of the sheet S or the sides of the left and right ends of the sheet S as the sheet S moves. Thus, it is possible to prevent the occurrence of wrinkles in the sheet S moving to the milars 24.

Further, static electricity at the closed surface of the sheet S is removed immediately before the sheet S is folded and conveyed by the folding rollers. Therefore, when a user opens the closed surface of the sheet S, no electrostatic force is generated at the closed surface of the sheet S. As a result, the user can easily open the closed surface of the sheet S.

Further, the elastic substances such as the mylars 24 provided on the conveyance guide plate are shaped in such a manner as to guide the sheet S to the mylars 24. Therefore, even if the thin paper poor in strength comes into contact with the elastic substance such as the mylars 24, it is possible to reduce a load at this time and prevent the occurrence of jam.

Second Embodiment

Figure 20:
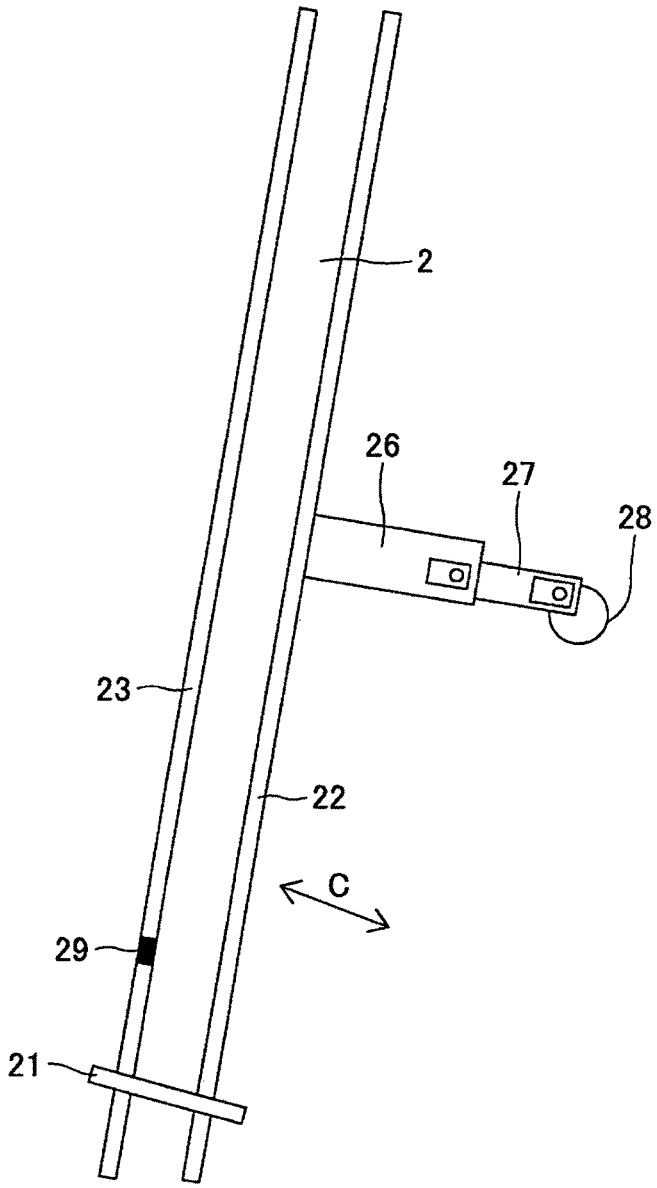
FIG. 20 is a diagram in which a driving mechanism is provided on one of the conveyance guide plates constituting the conveyance path.

Next, a second embodiment of the present invention is described. FIG. 20 is a diagram in which a driving mechanism is provided on one of the conveyance guide plates constituting the conveyance path. As shown in FIG. 20, the driving mechanism serving as a conveyance path space-controlling unit is connected to the stopper guide plate 22 constituting the conveyance path 2. The driving mechanism is constructed by, for example, an arm 26, an arm 27, and a cam 28. The cam 28 is connected to a motor, not shown. Further, the stopper guide plate 23 is attached to a sheet surface sensor 29. Note that the conveyance paths 3, 4, and the like can have the same configuration as the conveyance path 2.

The stopper guide plate 22 is capable of moving in the directions as indicated by an arrow C with the driving mechanism described above. When the stopper guide plate 22 moves to the stopper guide plate 23, a distance between the stopper guide plates 22 and 23 can be made smaller.

The stopper guide plate 22 moves to the stopper guide plate 23 at the following timing. That is, the distance between the stopper guide plates 22 and 23 is held to be normal until the sheet is conveyed onto the conveyance path 2 shown in FIG. 20. However, when the sheet passes through the stopper guide 22 and comes into contact with the stopper 21 at its tip end on the conveyance path 2, the stopper guide plate 22 immediately moves to the stopper guide plate 23 to reduce the distance between the stopper guide plates 22 and 23.

Specifically, when the sheet detection sensor 29 attached to the stopper guide plate 23 detects the tip end of the conveyed sheet, the motor is driven and the stopper guide plate 22 starts moving in the direction of the opposing stopper guide plate 23 driven through the cam 28, the arm 27, and the arm 26.

Further, until the deflection formed in the middle part of the sheet is folded and conveyed between the folding rollers 60 and 61, the stopper guide plate 22 is on standby and then returns to an initial position.

By making the distance between the stopper guide plates 22 and 23 smaller, it becomes possible to form the deflection of the sheet, which is formed when the sheet comes into contact with the stopper 21 at its tip end, at the position right above the nip of folding rollers 60 and 61.

As described above, according to the second embodiment, the distance between the conveyance guide plates provided between the folding units and the contact unit with which the sheet comes into contact is made smaller when the sheet comes into contact with the contact unit at its tip end or rear end to form the deflection at the middle part of the sheet. As a result, the sheet has a lesser degree of freedom to form the deflection between the conveyance guide plates, thereby controlling the deflection of the sheet.

Thus, it is possible to reduce the fluctuation of the deflection formed in the sheet and make the sheet be conveyed between the folding units at an expected folding position. As a result, the folding accuracy of the sheet ejected from the sheet processing apparatus can be improved.

Further, in the case of folding the sheet for the second or subsequent time, the distance between the conveyance guide plates provided between the folding units and the contact unit with which the sheet comes into contact is made smaller when the sheet comes into contact with the contact unit to form the deflection at its tip end or rear end on which folding lines have been formed on the upstream side.

As described above, the sheet has a lesser degree of freedom to form the deflection between the conveyance guide plates, thereby controlling the deflection of the sheet. Thus, it is possible to make the sheet be conveyed between the folding units at an expected folding position. As a result, the position of the middle part of the sheet conveyed between the folding units is not shifted. In addition, the position of the folding lines of the sheet formed on the upstream side is not shifted from the folding position of the sheet conveyed between the folding units. Therefore, the box folding phenomenon can be prevented.

Moreover, the driving mechanism for moving the conveyance guide plate, which is provided between the folding units and the contact unit with which the sheet comes into contact so as to make the distance between the conveyance guide plates smaller, is connected to only one of the conveyance guide plates. As a result, it is possible to simply configure the mechanism of the sheet processing apparatus at low cost.

As described above, according to the second embodiment of the present invention, the folding accuracy of the sheet can be improved.

The present invention is not limited to the specifically disclosed embodiments, and variations and modifications may be made without departing from the scope of the present invention.

The present application is based on Japanese Priority Application Nos. 2009-108104 filed on Apr. 27, 2009, and 2010-022391 filed on Feb. 3, 2010, the entire contents of which are hereby incorporated herein by reference.

What is claimed is:

1. A sheet processing apparatus that forms folding lines at a set position of a sheet after image formation and outputs the sheet, the apparatus comprising:

a contact unit with which a tip end or a rear end of the conveyed sheet comes into contact and by which a deflection is formed at a middle part of the sheet;

folding units that form the folding lines by conveying the middle part of the sheet, at which the deflection is formed by the contact unit, between the folding units; and a deflection controlling unit that controls the deflection at the middle part of the sheet formed by the contact unit, wherein a conveyance path is formed between the contact unit and the folding units, wherein the deflection controlling unit is provided to the conveyance path, and includes a pair of elastic substances extending in a conveyance direction of the sheet, the pair of elastic substances have a smooth front surface and are provided on the conveyance path having a set space in which the sheet is conveyed between the contact unit and the folding units, and wherein the pair of elastic substances are provided such that an interval between the pair of elastic substances gets smaller from an upstream side to a downstream side of the conveyance path.

2. The sheet processing apparatus according to claim 1, wherein the pair of elastic substances are provided symmetrically with respect to a center of the conveyance path.

3. The sheet processing apparatus according to claim 1, wherein the pair of elastic substances are plate-like members made of a conductive resin.

4. The sheet processing apparatus according to claim 1, wherein the conveyance path has a pair of conveyance guide plates, and the pair of elastic substances are provided on one of the pair of conveyance guide plates.

5. The sheet processing apparatus according to claim 4, wherein the other one of the pair of conveyance guide plates has grooves or through-holes at position opposite to the pair of elastic substances, and the pair of elastic substances are provided so as to overlap the other one of the pair of conveyance guide plates when the pair of elastic substances are inserted in the grooves or the through-holes.

6. The sheet processing apparatus according to claim 5, wherein the tip ends of the pair of elastic substances on an upstream side of the conveyance path are shaped such that the tip ends are distant from the other one of the pair of conveyance guide plates at most upstream positions thereof, and come closer to the other one of the pair of conveyance guide plates and finally make contact therewith on a downstream side of the conveyance path.

7. The sheet processing apparatus according to claim 1, wherein the deflection controlling unit comprises a conveyance path space-controlling unit that controls a space of a conveyance path having a set space in which the sheet is conveyed between the contact unit and the folding units, and the conveyance path space-controlling unit controls the space of the conveyance path until the middle part of the sheet is conveyed between the folding units after the tip end of the sheet passes through the conveyance path and comes into contact with the contact unit.

8. The sheet processing apparatus according to claim 7, wherein the conveyance path has a pair of conveyance guide plates, and the conveyance path space-controlling unit controls one of the pair of conveyance guide plates.

9. An image forming apparatus comprising the sheet processing apparatus according to claim 1.

10. The sheet processing apparatus according to claim 1, wherein the contact unit is movable along the conveyance path so as to correspond to the folding position, at the tip end thereof.

11. A sheet processing apparatus that forms folding lines at a set position of a sheet after image formation and outputs the sheet, the apparatus comprising:

a contact unit with which a tip end or a rear end of the conveyed sheet comes into contact and by which a deflection is formed at a middle part of the sheet;

folding units that form the folding lines by conveying the middle part of the sheet, at which the deflection is formed by the contact unit, between the folding units; and a deflection controlling unit that controls the deflection at the middle part of the sheet formed by the contact unit, wherein a conveyance path is formed between the contact unit and the folding units, wherein the deflection controlling unit is provided to the conveyance path, and includes a pair of elastic substances extending in a conveyance direction of the sheet, the pair of elastic substances have a smooth front surface and are provided on the conveyance path having a set space in which the sheet is conveyed between the contact unit and the folding units, and wherein the pair of elastic substances are plate-like members made of a conductive resin.

12. A sheet processing apparatus that forms folding lines at a set position of a sheet after image formation and outputs the sheet, the apparatus comprising:

a contact unit with which a tip end or a rear end of the conveyed sheet comes into contact and by which a deflection is formed at a middle part of the sheet;

folding units that form the folding lines by conveying the middle part of the sheet, at which the deflection is formed by the contact unit, between the folding units; and a deflection controlling unit that controls the deflection at the middle part of the sheet formed by the contact unit, wherein a conveyance path is formed between the contact unit and the folding units, wherein the deflection controlling unit is provided to the conveyance path, and includes a pair of elastic substances extending in a conveyance direction of the sheet, the pair of elastic substances have a smooth front surface and are provided on the conveyance path having a set space in which the sheet is conveyed between the contact unit and the folding units, wherein the conveyance path has a pair of conveyance guide plates, and the pair of elastic substances are provided on one of the pair of conveyance guide plates, wherein the other one of the pair of conveyance guide plates has grooves or through-holes at position opposite to the pair of elastic substances, and the pair of elastic substances are provided so as to overlap the other one of the pair of conveyance guide plates when the pair of elastic substances are inserted in the grooves or the through-holes.

13. A sheet processing apparatus that forms folding lines at a set position of a sheet after image formation and outputs the sheet, the apparatus comprising:

a contact unit with which a tip end or a rear end of the conveyed sheet comes into contact and by which a deflection is formed at a middle part of the sheet;

folding units that form the folding lines by conveying the middle part of the sheet, at which the deflection is formed by the contact unit, between the folding units; and a deflection controlling unit that controls the deflection at the middle part of the sheet formed by the contact unit, wherein a conveyance path is formed between the contact unit and the folding units, and wherein the deflection controlling unit is provided to the conveyance path, and includes two or more pressing members along the conveyance path having a set space in which the sheet is conveyed between the contact unit and the folding units, the two or more pressing members have a smooth front surface and are provided such that the shape which the one or more pressing members make becomes narrower toward a downstream side of the conveyance path.

14. The sheet processing apparatus according to claim 13, wherein the two or more pressing members are provided symmetrically with respect to a center of the conveyance path.

15. The sheet processing apparatus according to claim 13, wherein the two or more pressing members are plate-like members made of a conductive resin.

16. The sheet processing apparatus according to claim 13, wherein the conveyance path has a pair of conveyance guide plates, and the two or more pressing members are provided on one of the pair of conveyance guide plates.

17. The sheet processing apparatus according to claim 16, wherein the other one of the pair of conveyance guide plates has grooves or through-holes at position opposite to the two or more pressing members, and the two or more pressing members are provided so as to overlap the other one of the pair of conveyance guide plates when the two or more pressing members are inserted in the grooves or the through-holes.

18. The sheet processing apparatus according to claim 17, wherein the tip ends of the two or more pressing members on an upstream side of the conveyance path are shaped such that the tip ends are distant from the other one of the pair of conveyance guide plates at most upstream positions thereof, and come closer to the other one of the pair of conveyance guide plates and finally make contact therewith on a downstream side of the conveyance path.

19. The sheet processing apparatus according to claim 13, wherein the deflection controlling unit comprises a conveyance path space-controlling unit that controls a space of a conveyance path having a set space in which the sheet is conveyed between the contact unit and the folding units, and the conveyance path space-controlling unit controls the space of the conveyance path until the middle part of the sheet is conveyed between the folding units after the tip end of the sheet passes through the conveyance path and comes into contact with the contact unit.

20. The sheet processing apparatus according to claim 19, wherein the conveyance path has a pair of conveyance guide plates, and the conveyance path space-controlling unit controls one of the pair of conveyance guide plates.

21. An image forming apparatus comprising the sheet processing apparatus according to claim 13.

* * * * *

UNITED STATES PATENT AND TRADEMARK OFFICE

CERTIFICATE OF CORRECTION

PATENT NO. : 8,534,660 B2
APPLICATION NO. : 12/662630
DATED : September 17, 2013
INVENTOR(S) : Masao Honda It is certified that error appears in the above-identified patent and that said Letters Patent is hereby corrected as shown below:

Title Page, item (30) Foreign Application Priority Data should read as follows:

Feb. 3, 2010 (JP) ..... 2010-022391
Apr. 27, 2009 (JP) ..... 2009-108104

Signed and Sealed this
Thirty-first Day of December, 2013

Margaret A. Focarino

Margaret A. Focarino
*Commissioner for Patents of the United States Patent and Trademark Office*